US008139802B2

(12) United States Patent
Lotter et al.

(10) Patent No.: US 8,139,802 B2
(45) Date of Patent: Mar. 20, 2012

(54) HEARING APPARATUS HAVING COILS ARRANGED ORTHOGONAL TO ONE ANOTHER

(75) Inventors: Thomas Lotter, Nürnberg (DE); Jürgen Reithinger, Neunkirchen am Brand (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1300 days.

(21) Appl. No.: 11/823,717

(22) Filed: Jun. 28, 2007

(65) Prior Publication Data

US 2008/0037810 A1 Feb. 14, 2008

(30) Foreign Application Priority Data

Jun. 28, 2006 (DE) ..... 10 2006 029 717

(51) Int. Cl.
*H04R 25/00* (2006.01)

(52) U.S. Cl. ..... 381/331; 381/111; 381/326; 379/52; 379/55.1

(58) Field of Classification Search ..... 381/331, 381/111, 312, 315, 326; 379/52, 55.1
See application file for complete search history.

(56) References Cited

U.S. PATENT DOCUMENTS

| | | | | |
|---|---|---|---|---|
| 4,489,330 | A | 12/1984 | Marutake et al. | |
| 5,258,766 | A | 11/1993 | Murdoch | |
| 5,912,925 | A * | 6/1999 | Palermo et al. | 375/258 |
| 6,529,161 | B2 | 3/2003 | Fukushima et al. | |
| 2002/0105461 | A1 | 8/2002 | Fukushima et al. | |
| 2004/0076301 | A1 * | 4/2004 | Algazi et al. | 381/17 |

FOREIGN PATENT DOCUMENTS

| | | |
|---|---|---|
| DE | 38 54 051 T2 | 12/1988 |
| DE | 201 14 461 U1 | 9/2001 |
| DE | 601 09 268 T2 | 2/2006 |
| WO | 9852295 A1 | 11/1998 |

* cited by examiner

*Primary Examiner* — Jerome Jackson, Jr.
*Assistant Examiner* — Yu Chen

(57) ABSTRACT

Inductive transmission to a hearing apparatus and in particular to a hearing device is to be improved. To this end, it is proposed to equip the hearing apparatus with two or three orthogonal coils. The coil signals are added with different signs and that signal which exhibits the highest level is forwarded from the resulting signals for further processing. It is thus possible to ensure an optimum reception quality in all alignments of the hearing apparatus.

10 Claims, 2 Drawing Sheets

HEARING APPARATUS HAVING COILS ARRANGED ORTHOGONAL TO ONE ANOTHER

CROSS REFERENCE TO RELATED APPLICATIONS

This application claims priority of German application No. 10 2006 029 717.2 EP filed Jun. 28, 2006, which is incorporated by reference herein in its entirety.

FIELD OF INVENTION

The present invention relates to a hearing apparatus having two coils for inductive transmission. In particular, the present invention relates to a hearing device but also to other hearing apparatuses such as headsets, earphones and suchlike.

BACKGROUND OF THE INVENTION

Analog inductive transmission with a transmit and receive coil in the baseband is predominantly used for the purpose of wireless data transmission to hearing devices for telephoning or for inductive reception in buildings, e.g. churches. Here a large transmit coil is generally used in the floor or in the telephone and a correspondingly aligned receive coil is used in the hearing device.

In principle, in the case of inductive audio transmission by means of transmit and receive coils, the problem consists in that a significantly reduced signal quality can be expected if the coils are not aligned optimally in relation to one another. To this end, the left side of FIG. 1 shows an optimal alignment of a transmit coil SS and a receive coil SE. The two coils SS and SE are arranged coaxially here so that a transmission with the highest degree of efficiency results, since the receive coil SE lies parallel to the magnetic field lines.

If on the other hand the receive coil SE is not parallel to the magnetic field lines, the degree of efficiency of the inductive transmission drops accordingly. The most minimal receive signal can then be expected if the axis of the receive coil SE is perpendicular to the magnetic field lines. This case is shown on the right in FIG. 1.

The problem of inadequate alignment of the transmit and receive coils is intensified in that further to the development of hearing devices with digital, inductive receivers, the telephone coil is increasingly housed in a hearing device remote controller. Such a remote controller can and is essentially more easily moved than a hearing device. It will thus also frequently assume an inadequate alignment in respect of the magnetic field of the transmit coil.

Methods are known from the publication DE 201 14 461, with which the problem of reduced signal quality in the case of poor alignment can be counteracted by using a number of coils. A number of coils are positioned orthogonal to one another and search out the receive signal, which supplies the strongest useful signal, from the receive signals. If necessary, the input signals are weighted differently. However optimum reception is not always achieved by this means, irrespective of the alignment of the transmit and receive coils.

The publication DE 601 09 268 T2 discloses an apparatus for controlling an antenna. This comprises a triaxial magnetic bearing sensor having two magnetic bearing sensors, each of which detects two components of the geomagnetic vector in the directions of two of the three axes of a right-hand coordinate system. Each of the two magnetic bearing sensors measures voltages which are excited in two coils arranged orthogonal to one another.

Furthermore, the publication DE 38 54 051 T2 discloses an antenna structure for generating a uniform field. The antennas have coils, which are arranged according to orthogonal x-, y- and z-axes.

SUMMARY OF INVENTION

An object of the present invention thus consists in improving the reception quality during inductive transmission.

As a solution, a hearing apparatus having a first coil for inductive transmission and a second coil for inductive transmission is provided according to the invention, with the two coils being arranged orthogonal to one another, a third coil for inductive transmission being arranged orthogonal to the first and second coil, an evaluation circuit being connected to all three coils, in the evaluation circuit all the coil signals with the same sign being summed for a first output signal and each two of the three coil signals with the same sign and the third coil signal with the other sign respectively being summed for a second, third and fourth output signal, with the third coil signal for the second output signal being assigned to the first coil, for the third output signal to the second coil and for the fourth output signal to the third coil, and that output signal of the four output signals which exhibits the highest level being selected by the evaluation circuit for further processing.

The system according to the invention thus enables a reception which is optimal in all spatial directions, irrespective of the alignment of the transmit coils to the receive coil system. An optimum audio reception of this type is then attained with a single telephone coil system, if the direction of the transmit magnetic field runs parallel to the coil axis. With the multiple coil system according to the publication DE 201 14 461 U1, this optimum audio reception is only achieved for the alignment of the transmit field in the axis of one of the receive coils.

The evaluation circuit preferably cross-fades smoothly between the sum signal and the differential signal as an output signal and/or between the output signals in the case of three orthogonal coils. This enables the changeover between the coil output signals to be less disruptive or not perceived.

Furthermore, a changeover from the sum signal to the differential signal or from one of the output signals to another one in the case of three orthogonal coils can be carried out on the basis of a hysteresis in the evaluation circuit. This avoids frequent toggling in the case of minimal signal changes.

In accordance with a preferred embodiment, the hearing apparatus comprises a remote controller and a hearing device, with the orthogonal coils and the evaluation circuit being incorporated in the remote controller and the selected output signal being transmitted to the hearing device. The hearing device remote controller can thus be moved freely without the quality of the signal being adversely affected by an unfavorable alignment.

BRIEF DESCRIPTION OF THE DRAWINGS

The present invention is described in more detail with reference to the appended drawings, in which.

DETAILED DESCRIPTION OF INVENTION

The exemplary embodiments described in more detail below represent preferred embodiments of the present invention.

Figure 1:
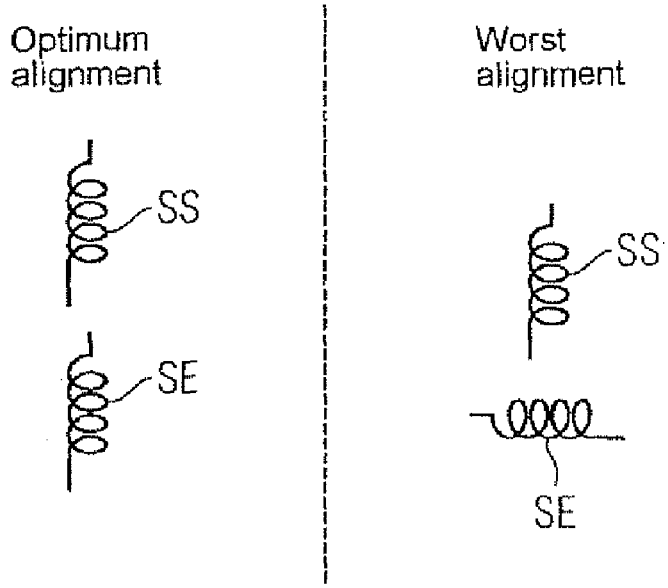
FIG. 1 shows two different arrangements of transmit and receive coils.
Figure 2:
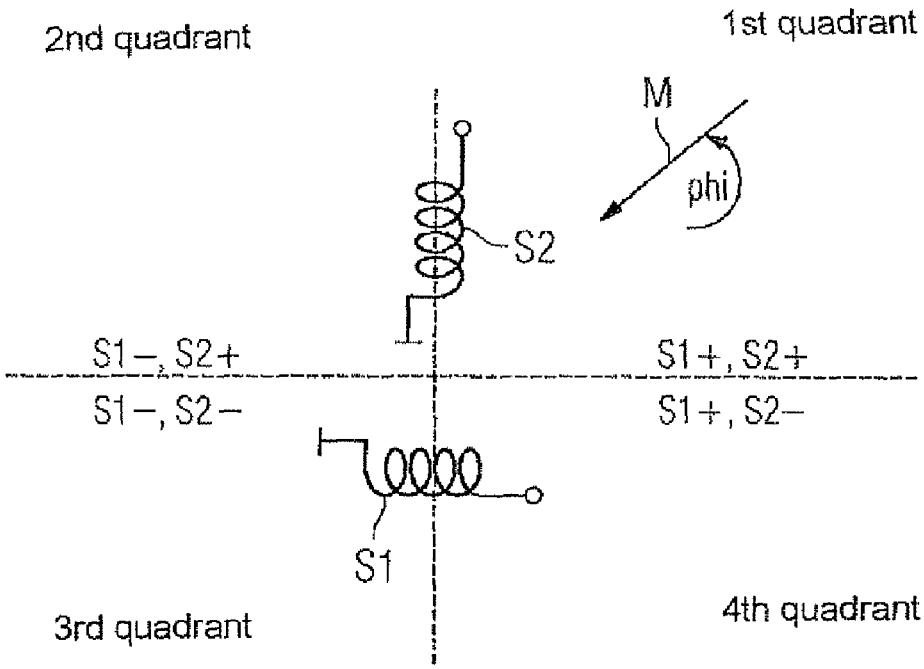
FIG. 2 shows two orthogonal receive coils in a transmission field.

The invention is based on the idea of accommodating two or three telephone coils, which are aligned orthogonal to one another, in the receive device and of combining the received signals of the coil to form an optimum overall signal. FIG. 2 illustrates this fundamental idea on the basis of two orthogonal receive coils S1 and S2, which are located in the magnetic field M of a transmitter. The angle of the directional vector of the magnetic field M is marked as phi. If the directional vector of the magnetic field, as illustrated in the example in FIG. 2, points from the direction of the first quadrant, the magnetic field will result in a positive signal in coil S1 and coil S2. The amplitude ratio of the signals is influenced by the angle phi, which determines the respective components along the plotted axis. For phi=45°, the same amplitude (and same phase) can be expected at both coils. For phi=90°, the signal at coil S1 completely disappears. For phi>90°, the sign of the signal, which is injected into coil S1, is reversed. The phase difference between the signals at coil S1 and coil S2 always amounts to 0° or 180°, since a transmission in the baseband is present.

Figure 3:
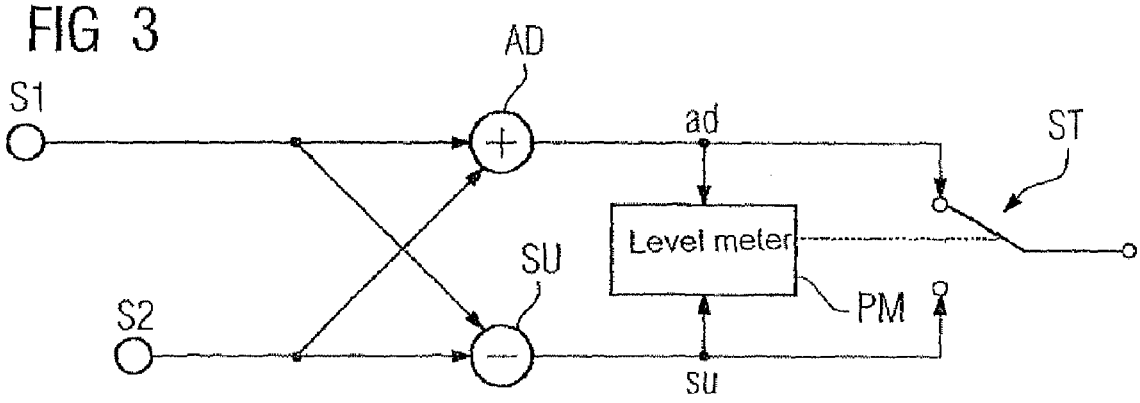
FIG. 3 shows an inventive evaluation circuit according to a first embodiment and FIG. 4 shows an inventive evaluation circuit according to a second embodiment.

Utilizing the knowledge obtained in conjunction with FIG. 2, an evaluation circuit is proposed in accordance with a first embodiment of the present invention for signal processing, as shown in FIG. 3. The signals of the two coils S1, S2 are alternately added up in an adding unit Ad and subtracted in a subtraction unit SU. Accordingly, an addition signal ad and a differential signal su result. Depending on the direction of the magnetic field, the coil signals are superimposed constructively in-phase and destructively out of phase. If the direction of the magnetic field of the transmitter lies in one of the coil axes, addition signal ad and differential and/or subtraction signal su are dominated by the corresponding coil by virtue of amplitudes received in a significantly different manner.

Once the angle of the field moves out of the coil axis, the coil signals are added together in correct phase sequence in one of the addition and differential signals ad, su formed and thus result in an optimum signal with amplified amplitude compared with a single coil signal. The other of the two addition and differential signals ad, su formed exhibits a reduced amplitude compared with the strongest coil signal due to superimposition in phase opposition.

Both signals, the addition signal ad and the differential signal su, are fed to a level meter PM. A level comparison is then used to forward either the sum signal and/or addition signal ad or the differential and/or subtraction signal su to a signal processing circuit (e.g. inductive, digital RF transmitter) (not shown). A switch ST controlled by the level meter PM is used to this end. A changed alignment of the receive coil by the user will in some instances then result in a change in the selected signal.

For practical considerations, in order for instance to avoid an excessively frequent and rapid changeover, the changeover can be slowed down in a smooth manner by fading in/fading out and by means of a hysteresis. To this end, the switch ST is provided with a corresponding electronic system.

Figure 4:
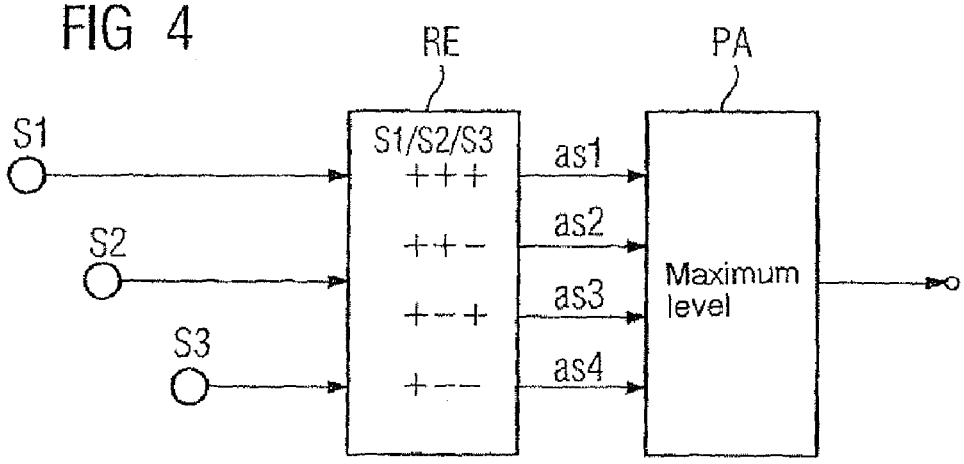

The evaluation principle illustrated for the two-dimensional according to FIG. 3 can be extended according to FIG. 4 to three dimensions. To this end, three coils S1, S2 and S3 are positioned orthogonal to one another in the hearing device and are added in a computing unit RE with all four possible sign combinations. In principle eight sign combinations are conceivable, however two of these combinations only represent a phase-displaced signal pair in each instance. A first output signal as1=S1+S2+S3, a second output signal as2=S1+S2−S3, a third output signal as3=S1−S2+S3 and a fourth output signal as4=S1−S2−S3 result from the computing unit RE. The signal with the highest level is then selected from the four output signals as1, as2, as3 und as4 in a level evaluator PA and output.

A preferred use of the evaluation circuits illustrated according to FIGS. 3 and 4 for processing telephone coil signals lies in their use for an inductive radio frequency hearing device remote controller. Here the telephone coil signal is injected into the remote controller and forwarded to the hearing device by means of digital RF transmission. The variable position of the remote controller during use means that scarcely one of the coils of the receive coil system is aligned parallel to the transmit magnetic field. Nevertheless optimum reception is always achieved with the system according to the invention. The proposed system according to the invention can, in principle, also be used for magnetic radio transmission in the non-baseband.

The invention claimed is:

1. A hearing apparatus, comprising:

a first coil for inductive transmission;

a second coil for inductive transmission arranged orthogonal to the first coil;

a third coil for inductive transmission arranged orthogonal to the first coil and to the second coil;

an evaluation circuit connected to all three coils, wherein in the evaluation circuit, all the coil signals with the same sign are summed for a first output signal and two of the three coil signals with the same sign and the third coil signal with the other sign respectively are summed for a second, third and fourth output signal, with the third coil signal for the second output signal being assigned to the first coil, for the third output signal to the second coil and for the fourth output signal to the third coil, and wherein the output signal which exhibits the highest level of the four output signals is selected by the evaluation circuit for further processing.

2. The hearing apparatus as claimed in claim 1, wherein the evaluation circuit allows a smooth cross-fading between the output signals.

3. The hearing apparatus as claimed in claim 1, wherein a changeover from one of the output signals to another output signal is made in the evaluation circuit based upon a hysteresis.

4. The hearing apparatus as claimed in claim 1, wherein the orthogonal coils and the evaluation circuit are incorporated in a remote controller and the selected output signal is transmitted to a hearing device.

5. A hearing device, comprising:

a first coil for an inductive transmission for a first coil signal;

a second coil for an inductive transmission for a second coil signal;

a third coil for an inductive transmission for a third coil signal;

an evaluation device to evaluate the coil signals, wherein:

in a first evaluation the first coil signal, the second coil signal and the third coil signal are added, in a second evaluation the second coil signal and the third coil signal are subtracted from the first coil signal, in a third evaluation the first coil signal is added to the second coil signal, wherein the third coil signal is subtracted, in a fourth evaluation the first coil signal is added to the third coil signal, wherein the second coil signal is subtracted;

wherein a first output signal is based upon the result of the first evaluation;

wherein a second output signal is based upon the result of the second evaluation;

wherein a third output signal is based upon the result of the third evaluation;

wherein a fourth output signal is based upon the result of the fourth evaluation, and wherein the output signal with the highest level of the four output signals is selected for further processing.

6. The hearing device as claimed in claim 5, wherein the first coil, the second coil and the third coil are arranged orthogonal to one another.

7. The hearing device as claimed in claim 5, wherein the hearing device is a headset.

8. The hearing device as claimed in claim 5, wherein the hearing device is an earphone.

9. The hearing device as claimed in claim 5, wherein the hearing device is a hearing apparatus.

10. The hearing device as claimed in claim 9, wherein the first coil, the second coil and the third coil are telecoils.

* * * * *